United States Patent [19]

Gustafsson

[11] 3,978,541

[45] Sept. 7, 1976

[54] DRY MOP ELEMENT

[76] Inventor: Gunnar Gustafsson, Hogabergsgatan 35, Jonkoping, Sweden

[22] Filed: Nov. 7, 1975

[21] Appl. No.: 629,699

Related U.S. Application Data

[63] Continuation-in-part of Ser. No. 460,301, April 12, 1974, abandoned.

[52] U.S. Cl. ..... 15/229 A; 15/224; 428/224; 428/293

[51] Int. Cl.[2] ..... A47L 13/20

[58] Field of Search ..... 15/208, 209 B, 222, 15/224, 226, 228, 229 R, 229 A, 229 AC, 229 AP, 229 B, 229 BP, 229 BC, 230.12, 230.16; 162/108; 128/63

[56] References Cited

UNITED STATES PATENTS

| | | | |
|---|---|---|---|
| 573,579 | 12/1896 | Donahoo | 15/222 |
| 759,155 | 5/1904 | Burt et al. | 15/224 |
| 2,273,833 | 2/1942 | Carpenter | 428/293 |
| 2,842,472 | 7/1958 | Hartstein | 428/108 |
| 3,593,359 | 7/1971 | Strauss | 15/229 BP |
| 3,627,621 | 12/1971 | Mowers | 428/293 |
| 3,827,099 | 8/1974 | Allaire et al. | 15/229 R |

*Primary Examiner*—Daniel Blum
*Attorney, Agent, or Firm*—Dorfman, Herrell and Skillman

[57] ABSTRACT

Dry mop comprising a sheet material and a multitude of parallel strands preferably in zig-zag runs spaced apart and attached to said sheet by means of glue, said strands being cylindrical and constituted of a soft, felt-like material and having a far greater thickness than said sheet, and wherein the distance between adjacent strands corresponds to the strand thickness. The glue is in a strip which fastens the strand by a limited part of its circumference to allow the strand to roll on its circumference when it is dragged across a surface to be cleaned.

9 Claims, 9 Drawing Figures

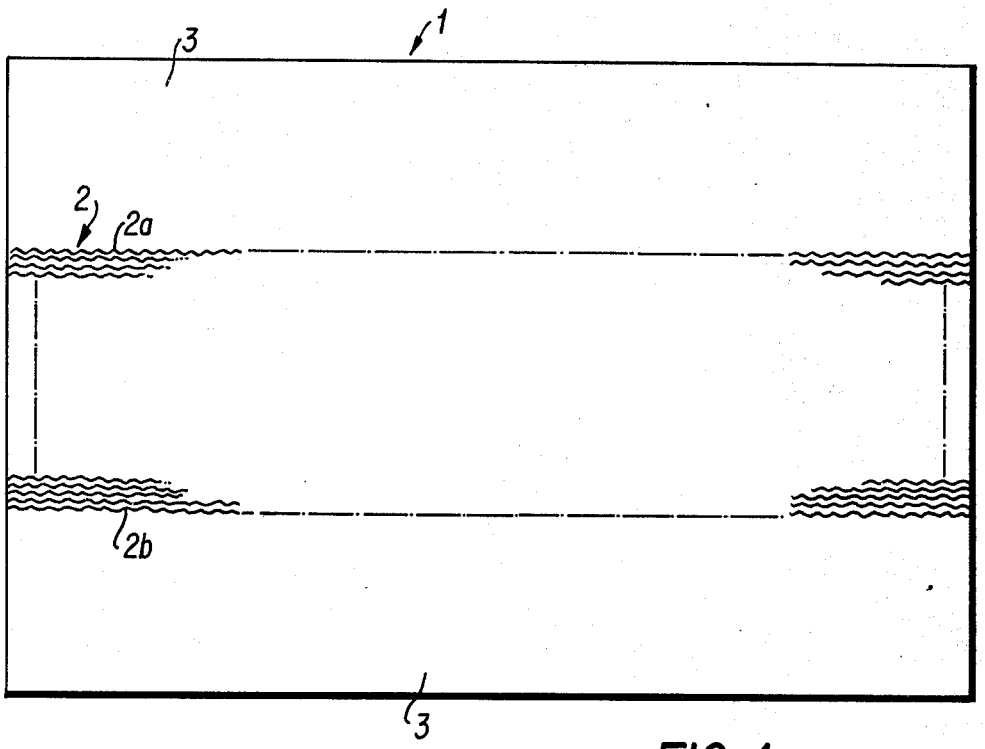
FIG. 1
FIG. 2
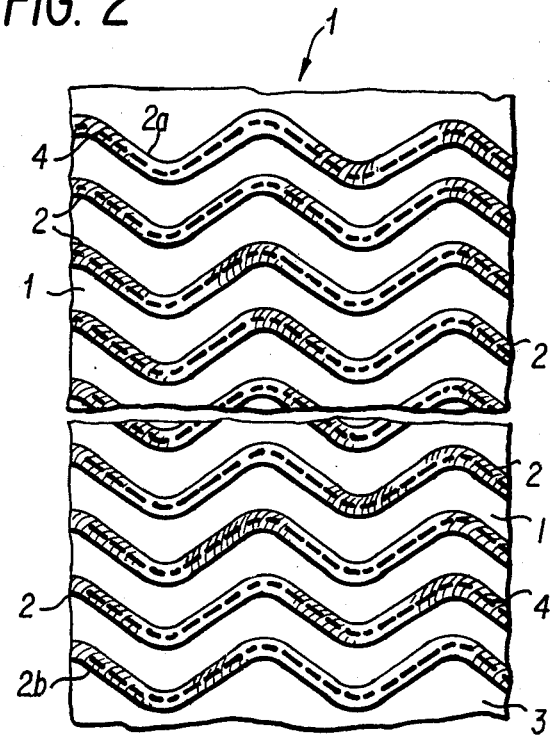
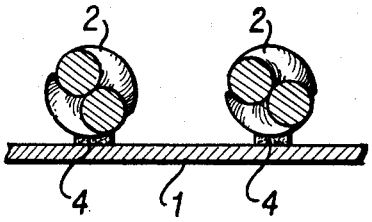
FIG. 3

FIG. 4
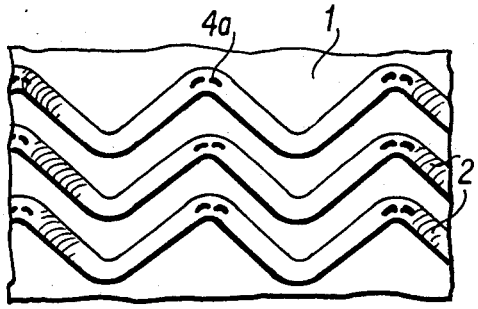
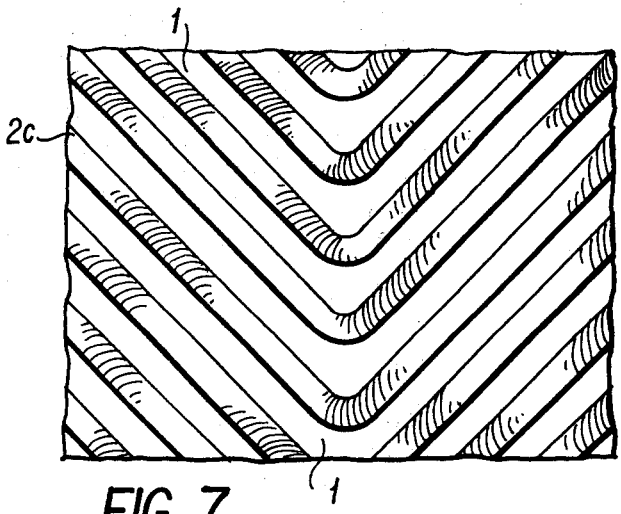
FIG. 7
FIG. 5
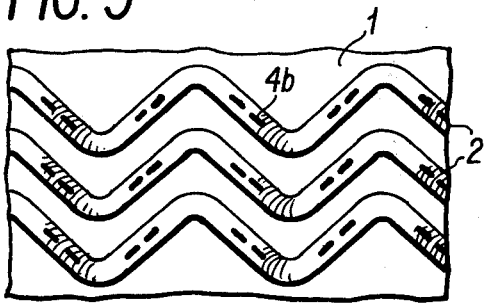
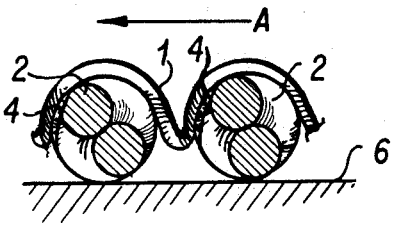
FIG. 8
FIG. 6
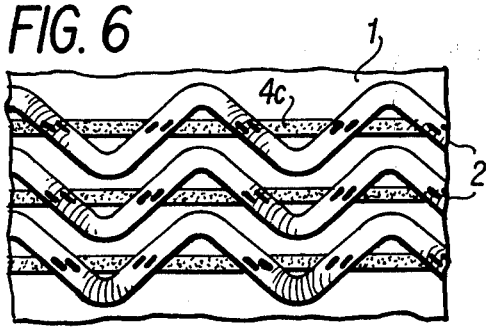
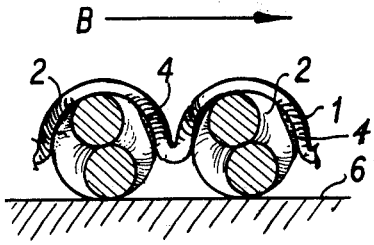
FIG. 9

DRY MOP ELEMENT

This application is a continuation-in-part of the copending application of Gunnar Gustafsson, Ser. No. 460,301, filed Apr. 12, 1974, now abandoned.

The present invention concerns a dry mop or duster or the like cleaning device, especially for one time use, which is designed to be fastened on a mop handle or a mop holder and which is provided with a foundation of a thin sheet material, for example paper, and a multitude of essentially parallel strands arranged in laterally-spaced relation to one another which are fastened to the foundation by means of glue or the like. In this description, the expression "dry mop" is to be construed to be a mop which will be used in a dry condition for wiping floors or the like.

Known mops for one time use consist of a sheet of paper or synthetic material, such as so-called "non-woven", or unwoven material (throw-away textile). Paper mops as well as non-woven mops suffer the drawback that they are somewhat uneven and thus glide badly over a floor, making mop work difficult.

Moreover, yarn mops are known which are washable. Each wash costs much more than a paper mop, which makes yarn mops relatively more expensive in use.

The task of the invention is above all to create a simple and inexpensive mop of throw-away type or one-time use type, which requires only little expenditure in working with the mop and which easily glides on ordinary floors such as, for example, plastic tile. This task will, according to the invention, be solved in that the mop's strands consist of a soft, preferably felt-like material and have a far greater thickness than the foundation and are arranged in laterally-spaced relation to one another, a distance corresponding to the strand thickness, so that the strands may roll on their outer periphery as the mop is dragged across the surface to be cleaned.

Further advantages and features of the mop according to the invention are made clear from the following description and the enclosed drawings which illustratively and not as limited examples illustrate some embodiments.

FIG. 1 is a face view of a mop element according to a preferred form of the invention;

FIG. 2 is a fragmentary face view of the mop element shown in FIG. 1 with portions broken away, and shown in larger scale;

FIG. 3 is a further enlarged sectional view of the element shown in FIGS. 1 and 2, showing the fastening of the strand to the foundation;

FIGS. 4, 5, 6 and 7 are fragmentary face views of the central part of a mop with modified strand patterns in the same scale as FIG. 2;

FIGS. 8 and 9 are cross sections similar to FIG. 3, through a small part of the foundation and two adjacent strands fastened to it, in greatly enlarged scale, to illustrate the rolling action when the element is dragged across the surface.

The mop according to the invention comprises a foundation 1 of grooved sheet-formed material, preferably paper. The paper or the like should be dry and of low absorbency, as well as flexible. It can preferably be crinkled. The sheet material can appropriately be rectangular and have dimensions of about 350 × 600 mm and is to be suited and designed to be folded around, respectively, fastened to a so-called mop head or a mop holder. The mop holder comprises a soft cushion with an essentially even work surface of about 140 × 600 mm. According to the invention, on each sheet 1 is a multitude of strands 2 which are preferably evenly distributed over the last mentioned work surface, fastened by means of glue 4 or the like. The binding agent for fastening of the strands 2 is suitably a fast-drying, water-emulsifiable glue.

It follows from the exemplified dimensions given above that both the side strips 3,3 may be folded around the mop head above the first strands 2*a* and below the lowermost strand 2*b* in FIGS. 1 and 2, and are then 105 mm wide each.

The strands 2 should consist of a light and soft, felt-like or hairy material, which can, with preference, be twined or twisted of two or more rovings or yarns. A suitable yarn is cotton yarn with the designation 2/2, which is twisted of two soft, hairy strands which normally have a diameter of about 1.5 mm, not in pressed together or flattened condition. As is especially made clear in FIG. 3, the strands have a diameter that is many times greater than the thickness of the foundation 1 and the spacing between two adjacent strands corresponds to the strand thickness.

In the preferred embodiments, the strands extend lengthwise along the mop. As is shown in the drawing, the strands 2 preferably extend in zig-zag or wavy lines. The waves can have variable wave height or amplitude. In FIG. 7, the central part of a mop is shown which includes a foundation sheet 1 and strands 2*c* which comprise only one wave length (at a maximum) along the entire length of the sheet.

According to FIGS. 1–3, the strands are attached to the foundation in their entire length by a continuous line of adhesive 4 coextensive with the strand and which is confined to a limited part of the circumference of the strand as shown in FIG. 3. The strip 4 has a width less than the strand thickness.

In FIGS. 4 and 5, the strands are attached to the foundation along their entire length by intermittent glue strips 4*a* and 4*b*, respectively. In FIG. 4, this intermittent gluing or the like 4*a* is provided in the vicinity of at least each second bend, and in FIG. 5, the gluing 4*b* is in the vicinity of the straight strand sections. In FIG. 6, continuous straight glue strips 4*c* are coextensive with the strands and cross through the strands 2 extending in wavy or zig-zag lines, to provide intermittent attachment of the strands along their entire length. The strands in the illustrated embodiments extend continuously along their length and the gluing causes the strands 2 to lie flush against the foundation 1 throughout their entire length.

The anchoring of the strands along their length by a glue strip which engages only a limited part of the circumference of the cylindrical strand provides a strong dirt take-up capability. As shown in FIGS. 8 and 9, flexing of the flexible foundation sheet 1, when attached tangentially at 4 to only a limited part of the circumference, allows the strands to roll on their circumference when they are dragged in a direction transverse to the longitudinal axes of the strands 2. When dragged in the direction A in FIG. 8, the strands 2 may roll counterclockwise to the limit shown before they skid along the surface 6. When the direction is reversed, as shown at B in FIG. 9, the strands 2 may roll clockwise to the limit shown before they skid along the surface 6. FIGS. 8 and 9 are illustrative of the condition where the foundation is highly flexible and/or elastic so as to permit the high degree of rolling illustrated. For less flexible foundation material, the extent of rolling is reduced. The rolling of the strands 2 exposes a major proportion of the circumference of the strands to direct contact with the surface 6 and effects pick-up and retention of a large amount of dust before the mop element becomes saturated and ineffective.

New embodiments in particular, which also lie within the scope of the invention can be created, in which different details of the different examples can in a purposeful way be combined with one another. The mops can further be divided from one another by means of lines of perforations and be connected one to one rolled together on a roll instead of being arranged in bundles, completely separate from one another such as is presupposed above.

The embodiments described above and illustrated in the drawings are naturally only to be considered as unlimited examples and may be modified in different ways with reference to their individuality within the scope of the following claims.

I claim:

1. An element for use a dry mop, dry duster or the like adapted for one-time use and for fastening on a mop head or mop holder, said structure comprising a foundation consisting of a thin flexible sheet of non-woven material having low moisture absorption capacity, and a multitude of strands arranged in substantially parallel lines extending parallel to the length of said foundation sheet, characterized in that the strands consist of soft, fibrous material of substantially cylindrical cross section having a far greater thickness than the foundation sheet, and glue strips engaging a limited part of the circumference of the cylindrical strand and fastening each strand to the sheet in substantially tangential relation thereto, said strips positioning said strands in flush engagement with the sheet continuously along the entire length of the sheet and laterally spaced apart from one another a distance corresponding to the strand thickness, so that upon flexing said foundation sheet as the element is dragged across a surface in a direction transverse to the cylindrical axis of a strand, said strand is free to roll on its circumference on the surface.

2. An element according to claim 1 wherein said strand lines comprise wavy or zig-zag lines.

3. An element according to claim 2 wherein said glue strips extend continuously coextensively with said strand lines.

4. An element according to claim 3 wherein said glue strips have a width less than the thickness of the strand and comprise wavy or zig-zag lines coincident with said strand lines.

5. An element according to claim 3 wherein said glue strips have a width less than the thickness of the strand and comprise substantially straight lines which cross the zig-zag lines of the strnds and fasten the strands in flush engagement with the sheet intermittently at the crossover points.

6. An element for use as a dry mop, dry duster or the like adapted for one-time use and for fastening on a mop head or mop holder, said structure comprising a foundation consisting of a thin flexible sheet of non-woven material having low moisture absorption capacity, and a multitude of strands arranged in wavy or zig-zag lines substantially parallel to one another and extending parallel to and along the length of said foundation sheet, characterized in that the strands consist of soft fibrous material of substantially cylindrical cross section having a far greater thickness than the foundation sheet, and including glue strips engaging a limited part of the circumference along the entire length of the cylindrical strand whereby the strand is fastened to the sheet in substantially tangential relation thereto, said strands extending longitudinally along the entire length of the sheet, and being laterally spaced apart from one another a distance corresponding to the strand thickness.

7. An element according to claim 6 characterized in that the foundation sheet consists of a paper.

8. An element according to claim 7 characterized in that the foundation sheet consists of a stretchable or elastic paper.

9. An element according to claim 7 characterized in that the foundation sheet consists of a crinkled paper.

* * * * *